United States Patent [19]

Hodge

[11] 4,024,974

[45] May 24, 1977

[54] DETENT RELEASE MEANS FOR LOADER BUCKET POSITIONERS

[75] Inventor: Norman J. Hodge, Peoria, Ill.

[73] Assignee: Caterpillar Tractor Co., Peoria, Ill.

[22] Filed: June 13, 1975

[21] Appl. No.: 586,846

[52] U.S. Cl. ..... 214/762; 91/358 A; 172/466

[51] Int. Cl.[2] ..... E02F 3/85

[58] Field of Search ..... 214/762, 764; 37/DIG. 1; 172/465, 466; 91/358 A

[56] References Cited

UNITED STATES PATENTS

| | | | |
|---|---|---|---|
| 545,074 | 8/1895 | Heath | 91/358 A |
| 3,197,051 | 7/1965 | Thickpenny | 214/764 |
| 3,420,393 | 1/1969 | Omon | 214/764 |
| 3,506,149 | 4/1970 | Gray | 214/764 |
| 3,547,293 | 12/1970 | Borer et al. | 214/764 X |

*Primary Examiner*—L. J. Paperner
*Attorney, Agent, or Firm*—Phillips, Moore, Weissenberger, Lempio & Majestic

[57] ABSTRACT

A loader comprises a pair of lift arms having a bucket pivotally mounted on the forward ends thereof. A tilt linkage, including at least one double-acting cylinder, is operatively connected between the lift arms and the bucket to selectively position the bucket in response to actuation of a control valve operatively connected thereto. A detent mechanism, including a housing movably mounted on the loader, is operatively connected to the control valve for holding it in a rack-back condition of operation. A cable is operatively interconnected between the housing and the cylinder for automatically moving the housing to release the detent mechanism in response to actuation of the cylinder for permitting the control valve to return to a neutral condition of operation.

14 Claims, 5 Drawing Figures

10
11
12
13
14
15
16
17
18
19
20
21
22
23
24
25
26
28
32
33
34
35
36
39
42
63
69

D.
H.
R.B.

DETENT RELEASE MEANS FOR LOADER BUCKET POSITIONERS

BACKGROUND OF THE INVENTION

Conventional loaders are adapted to perform various digging, loading and carrying fuctions during a cycle of loader operation. During certain phases of loader operation, such as rack-back of the bucket after it has been loaded, it is desirable to provide means to continue the rack-back action and to stop such action automatically. The operator is thus free to direct his attention elsewhere, as needed.

SUMMARY OF THIS INVENTION

An object of this invention is to provide a construction vehicle, such as a loader, with improved detent and release means for automatically releasing a valve means of a control means upon actuation of a fluid-actuated cylinder operatively connected to a work tool for selectively moving the same. The valve means, positionable between first, second and third conditions of operation, is operatively connected to the detent means which includes a housing movably mounted on the vehicle and normally holding the valve means in such first condition. The release means is interconnected between the housing and the cylinder for automatically moving the housing to release the detent means in response to actuation of the cylinder to permit the valve means to return to its second condition. In the preferred embodiment of this invention, such second condition will function to block communication of fluid to the cylinder whereby the work tool is held in its work position to free the operator for other work tasks.

BRIEF DESCRIPTION OF THE DRAWINGS

Other objects of this invention will become apparent from the following description and accompanying drawings wherein.

DETAILED DESCRIPTION

Figures 1, 5:
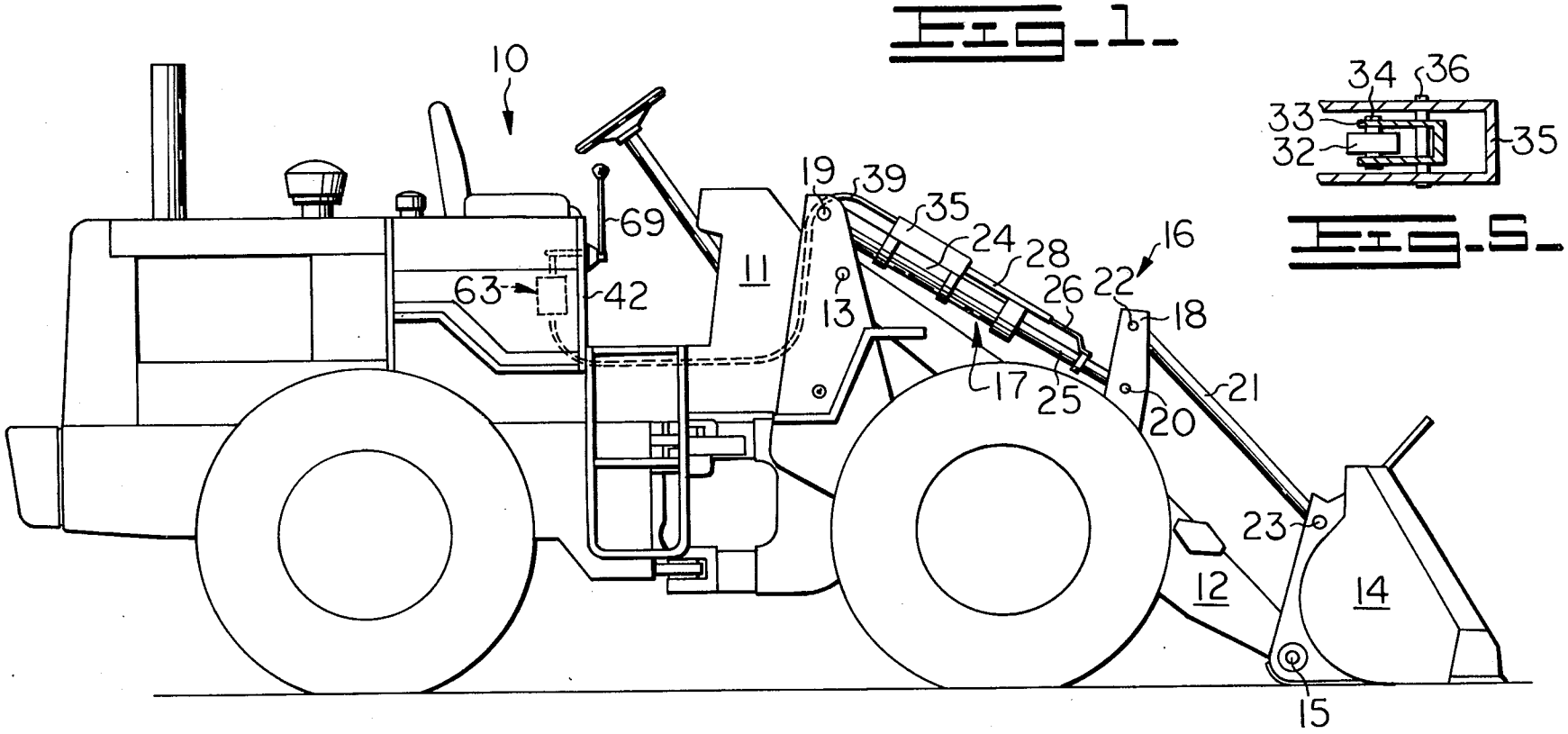
FIG. 1 is a side elevational view of a wheel loader, employing the detent and release means of this invention thereon.
FIG. 5 is a sectional view of a portion of the release means, taken in the direction of arrows V—V in FIG. 3.

FIG. 1 illustrates a wheel loader 10 comprising a frame 11 having a pair of lift arms 12 (one shown) each pivotally mounted thereon by a pivot pin 13. The lift arms have a bucket 14 pivotally mounted on the forward ends thereof by laterally spaced pivot pins 15 (one shown). Although the hereinafter described invention finds particular application to such loader, it should be understood that the invention may be adapted for use to selectively position other types of work tools and implements movably mounted on a construction vehicle.

Each lift arm is adapted to be selectively raised or lowered by double-acting hydraulic cylinder (not shown) pivotally interconnected between frame 11 and lift arm 12. A conventional tilt linkage or bucket positioning means 16 is pivotally interconnected between each lift arm and the bucket to move it through its various work positions. The tilt linkage comprises a hydraulically actuated double-acting cylinder 17 pivotally interconnected between frame 11 and a lever 18, having its lower end pivotally mounted on lift arm 12, by pins 19 and 20, respectively. The tilt linkage further comprises a rod 21 pivotally interconnected between lever 18 and bucket 14 by pins 22 and 23, respectively.

Figures 2, 3, 4:
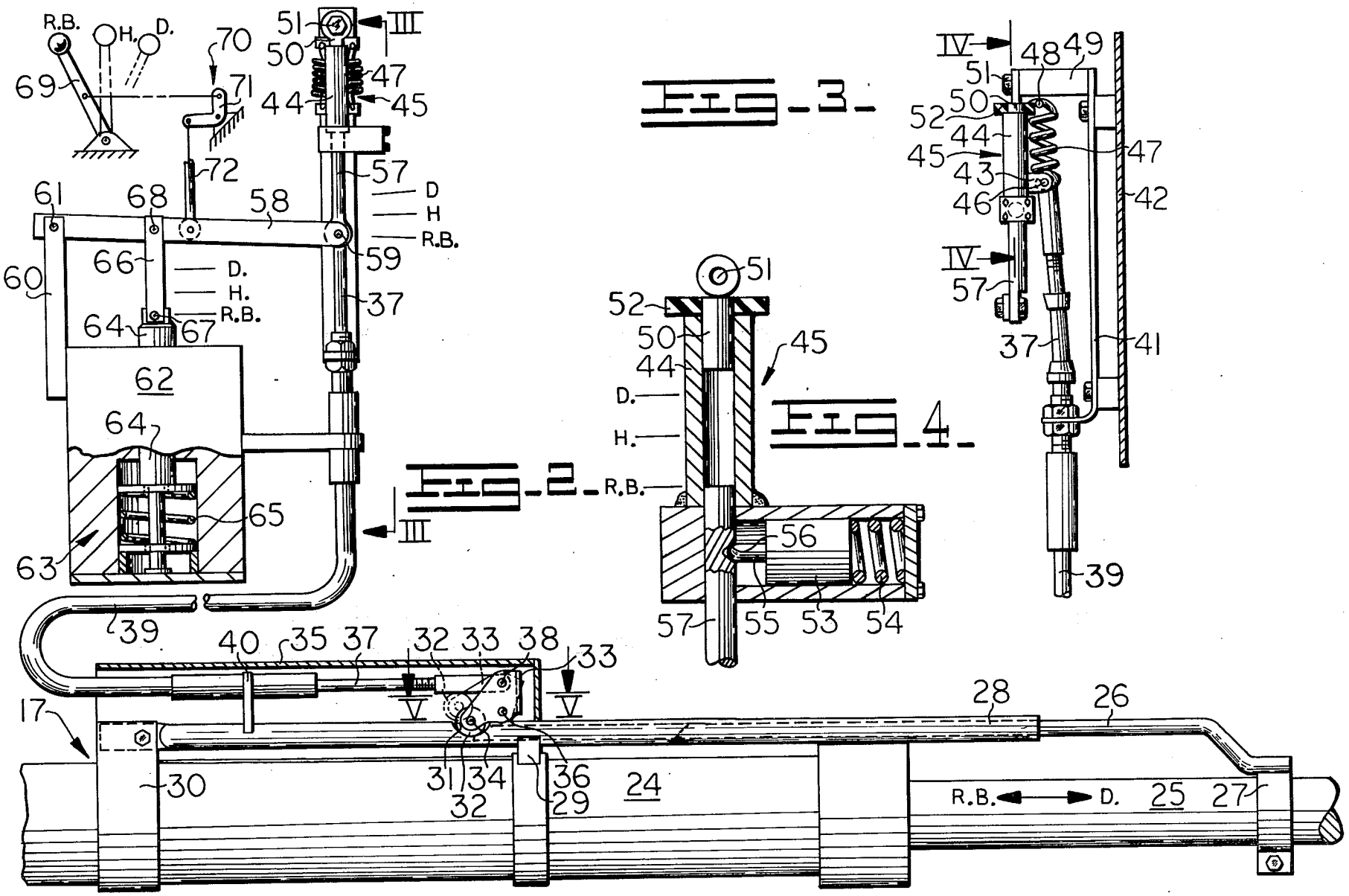
FIG. 2 is a partially schematic and sectioned view, illustrating the detent and release means operatively connected to a control means for selectively actuating a double-acting cylinder.
FIG. 3 is a side elevational view of the detent means and attendant structures, taken in the direction of arrows III—III in FIG. 2.
FIG. 4 is an enlarged sectional view of the detent means, taken in the direction of arrows IV—IV in FIG. 3.

Referring to FIG. 2, cylinder 20 comprises a cylindrical housing 24 having a piston rod 25 reciprocally mounted therein. A rod or slide bar 26 is secured to the piston rod by a bracket 27 and is slidably mounted in a tube 28. The tube is secured to housing 24 by a pair of longitudinally spaced brackets 29 and 30. The tube has an arcuate notch 31 formed thereon adapted to normally seat a roller 32 therein.

As shown in FIGS. 2 and 5, the roller is rotatably mounted on a bifurcated bracket or bellcrank 33 by a pin 34. A protective shroud 35 is secured to brackets 289 and 30 and has bellcrank 33 pivotally mounted thereon by a pin 36. A second end of the bellcrank is pivotally attached to a flexible cable 37 by a pin 38. The cable is reciprocally mounted in a protective tube 39 secured to tube 28 by a bracket 40. As shown in FIG. 3, the second end of the tube is attached to an elongated and vertically disposed bracket 41 which is, in turn, attached to a panel 42 of the vehicle which is integrally connected to the frame thereof.

The upper end of cable 37 is attached to a lug 43, secured to a housing 44 of a detent means 45, by a pin 46. A tension coil spring 47 is interconnected between pin 46 and a pin 48 secured to an upper arm 49 of bracket 41. A guide means in the form of a plunger 50 has its upper end attached to arm 49 by a cap screw 51.

Referring to FIG. 4, an annular elastomeric sealing gasket 52 is secured to the upper end of housing 44 to prevent the egress of contaminants into the housing upon reciprocation of the housing relative to plunger 50. The detent means further comprises a cylindrical plunger 53 reciprocally mounted in housing 44 for movement perpendicular to relative movement of plunger 50. Plunger 53 is spring-biased leftwardly by a compression coil spring 54 to normally engage a detent 55 formed on the plunger with a notch 56 formed in a rod 57.

As shown in FIG. 2, the upper end of rod 57 is reciprocally mounted in housing 44 and has its lower end connected to a first end of a lever 58 by a pin 59. The second end of the lever is pivotally mounted on an upstanding bracket 60 by a pin 61. The bracket is secured to a side of a housing 62 of a control means, including a valve means 63 preferably constituting a three-position directional control valve.

The control valve comprises a spool 64 reciprocally mounted therein and positionable between the illustrated rack-back (R.B.), hold (H) amd dump (D) conditions of valve operation. The spool is normally biased to its intermediate hold or neutral condition of operation by a centering spring 65 whereby communication of pressurized fluid to cylinder 17 is blocked. A link 66 is pivotally interconnected between an upper end of the valve spool and lever 58 by pins 67 and 68, respectively.

A control handle 69 is pivotally mounted on the vehicle and operatively connected to lever 58 by linkage means schematically illustrated at 70. Such linkage means may comprise a bellcrank 71 pivotally mounted on the vehicle and having its ends pivotally connected to handle 69 and the rod 72. The lower end of the rod is pivotally connected to lever 58 to permit the operator to selectively actuate control valve 63 into one of the three aforementioned conditions of operation.

FI. 1 illustrates the loader in its digging position of operation wherein bucket 14 is maintained at ground level. After the bucket is loaded, the operator will raise the bucket (actuate the lift cylinder) and at the same time will rack-back the bucket to prevent the load from falling out. Referring to FIG. 2, the operator would move control handle 69 to the rack-back (R.B.) position shown and thus set the detent mechanism as shown in FIG. 4, allowing him to place his attention elsewhere. When handle 69 is moved to its rack-back position, cylinder 17 will retract causing rod 25 to retract into housing 24 thus retracting rod 26 into housing 28. When rod 26 intersects with notch 31 roller 32 will be disengaged therefrom. Upon pivoting of the roller and bellcrank 33 to their phantom-line positions, cable 37 will be retracted to, in turn, retract housing 44 relative to rod 57.

The release means thus provided will function to release detent 55 from notch 56 of detent means 45 (FIG. 4) which has to such time held valve spool 64 in its rack-back rack-back (R.B.) condition of operation. Release of detent 55 will thus permit spring 65 to return to valve spool to its hold (H) condition. When rod 25 of the cylinder is again extended for a dump operation, for example, roller 32 will reseat in notch 31, and detent housing 44 will again be in position to allow detent 55 to engage notch 56 when rod 57 is moved to the rack-back (R.B.) position by the operator. Roller 32 will reseat in notch 31, for the above condition, by action of spring 47 (FIG. 3) pulling upward on cable 37.

I claim:

1. A construction vehicle comprising a work tool movably mounted thereon, at least one fluid-actuated cylinder operatively connected to said work tool for selectively moving said work tool on said vehicle to a work position thereon, control means comprising valve means operatively connected to said cylinder and positionable between first and second conditions of operation, detent means, including a housing movably mounted on said vehicle, a plunger having a detent thereon reciprocally mounted in said housing an spring means disposed between said housing and said plunger for normally biasing said detent into engagement with a notch formed in a rod reciprocally mounted in said housing, operatively connected to said valve means for normally holding said valve means in said first condition of operation and release means interconnected between said housing and said cylinder for automatically moving said housing to release said detent means in response to actuation of said cylinder for permitting said valve means to return to its second condition of operation.

2. The vehicle of claim 1 wherein said valve means comprises a spool reciprocally mounted therein for movement between said first conditon of operation for communicating pressurized fluid to said cylinder to move said work tool to its work position and normally biased to said second condition of operation for blocking communication of fluid to and from said cylinder whereby said work tool is held in its work position.

3. The vehicle of claim 1 wherein said cylinder comprises a piston rod reciprocally mounted in a housing thereof and said release means comprises a slide bar attached to said piston rod for reciprocal movement therewith.

4. The vehicle of claim 3 wherein said release means further comprises a tube attached to the housing of said cylinder, said slide bar reciprocally mounted in said tube.

5. The vehicle of claim 4 wherein said release means further comprises means forming a notch in said tube adapted to be intersected by said slide bar upon reciprocal movement thereof.

6. The vehicle of claim 5 wherein said release means further comprises a roller normally at least partially seated in said notch and adapted to be engaged by said slide bar for movement out of said notch upon reciprocation of said slide bar.

7. The vehicle of claim 6 wherein said release means further comprises a cable having a first end thereof connected to a bracket pivotally mounted on the housing of said cylinder, said roller is rotatably mounted on said bracket and a second end of said cable is attached to the housing of said detent means.

8. The vehicle of claim 7 further comprising a protective shroud attached to the housing of said cylinder to cover said bracket and roller, said bracket pivotally mounted on said protective shroud.

9. The vehicle of claim 1 wherein said rod is pivotally connected to a lever pivotally mounted on a housing of said valve means.

10. The vehicle of claim 9 wherein said valve means comprises a spool reciprocally mounted therein and wherein said lever is pivotally connected to said spool.

11. The vehicle of claim 10 wherein said control means further comprises handle means movably mounted on said vehicle and operatively connected to said lever for selectively moving said spool and said rod simultaneously.

12. The vehicle of claim 1 wherein an upper end of said housing is reciprocally mounted on a plunger attached to said frame.

13. The vehicle of claim 1 wherein said work tool constitutes a bucket pivotally mounted on forward ends of a pair of lift arms having their rearward ends pivotally mounted on said frame and wherein said cylinder is included in tilt linkage means pivotally interconnected between said frame, lift arms and bucket for selectively moving said bucket on said lift arms.

14. A construction vehicle comprising a work tool movably mounted thereon, at least one fluid-actuated cylinder operatively connected to said work tool for selectively moving said work tool on said vehicle to a work position thereon, control means comprising valve means operatively connected to said cylinder and positionable between first and second conditions of operation, detent means, including a housing having an upper end thereof reciprocally mounted on a first plunger attached to said frame and a second plunger having a detent thereon reciprocally mounted in said housing, operatively connected to said valve means for normally holding said valve means in said first condition of operation and release means interconnected between said housing and said cylinder for automatically moving said housing to release said detent means in response to actuation of said cylinder for permitting said valve means to return to its second condition of operation.

* * * * *